US006306295B1

(12) United States Patent
Giacalone

(10) Patent No.: US 6,306,295 B1
(45) Date of Patent: Oct. 23, 2001

(54) SWIMMING POOL FLOAT NET

(76) Inventor: Nicholas Giacalone, 349 Ridgeway, Cottage Hills, IL (US) 62018

( * ) Notice: Subject to any disclaimer, the term of this patent is extended or adjusted under 35 U.S.C. 154(b) by 0 days.

(21) Appl. No.: 09/656,343

(22) Filed: Sep. 6, 2000

(51) Int. Cl.[7] ..... E04H 4/14

(52) U.S. Cl. ..... 210/169; 210/495; 4/490; 4/496

(58) Field of Search ..... 210/169, 232, 210/495, 499; 4/490, 496

(56) References Cited

U.S. PATENT DOCUMENTS 3,625,364 * 12/1971 La Chance ..... 210/169
3,840,118 * 10/1974 Whitmore ..... 210/169
3,863,237 * 1/1975 Doerr ..... 210/169
4,053,412 * 10/1977 Stix ..... 210/169
4,369,109 * 1/1983 Edge ..... 210/169
5,043,060 * 8/1991 Brennan ..... 4/496
5,139,660 * 8/1992 Lourie et al. ..... 4/496
5,223,135 * 6/1993 MacPhee et al. ..... 4/490
5,277,801 * 1/1994 Lundquist ..... 4/490
5,705,058 * 1/1998 Fischer ..... 210/169
5,833,845 * 11/1998 Anderson ..... 210/169
5,911,878 * 6/1999 Benvenuto et al. ..... 210/169

* cited by examiner

*Primary Examiner*—Christopher Upton
(74) *Attorney, Agent, or Firm*—Peter R. Bahn

(57) ABSTRACT

A swimming pool float net is described which hangs onto the side or fence of a swimming pool. The float net can be multiplied in size with additional units. The float net can be folded when temporarily not in use or completely disassembled into a compact form when not be used for long periods of time.

4 Claims, 2 Drawing Sheets

SWIMMING POOL FLOAT NET

DESCRIPTION OF THE INVENTION

This invention fits into the general category of swimming pool accessories. More particularly, this invention fits into the category of swimming pool storage holders. Specifically, this invention fits into the category of being a storage net for holding swimming pool floatation devices.

It is a well known fact that various floatation devices or floats, such as rings, balls, tubes, mattresses, and other shapes, some inflatable and others of solid foam, are frequently used by people in swimming pools. However, such swimming pool floats frequently clutter up the swimming pool area, and it would be convenient to have a suitable storage space to temporarily store the swimming pool floats when they are not in use.

It is an object of the present invention, a swimming pool float net, to meet such a need. It is also an object of the present invention to provide a temporary storage space for swimming pool floats such that the floats are out of the way of the swimming area but still visible in case of their desired use. It is a further object of this invention that the size of the float net can be multiplied a number of times if necessary. It also is a further object of the present invention that the swimming pool float net can be folded up, if so desired, when it is not being actively used. Finally, it is an object of the invention that the swimming pool float net can be easily assembled or disassembled from a compact kit for packaging and storage.

Such objects are achieved in the present invention to be described herein. In summary, the present invention comprises a rectangular net suspended between two long thin poles or pipes. The inner side of the pipe-net assembly is attached to two other pipes with curved tops and bottoms that hang on and grip the sides of an above-ground swimming pool or a fence surrounding an in-ground swimming pool. The outer side of the pipe-net assembly is held up by two under-side pipes that attach to the bottoms of the curved hanging-and-gripping pipes. The float net can be folded up flat against the sides of the pool or fence when not being used. The float net can also be disassembled into individual pipe segments.

Figure 1:
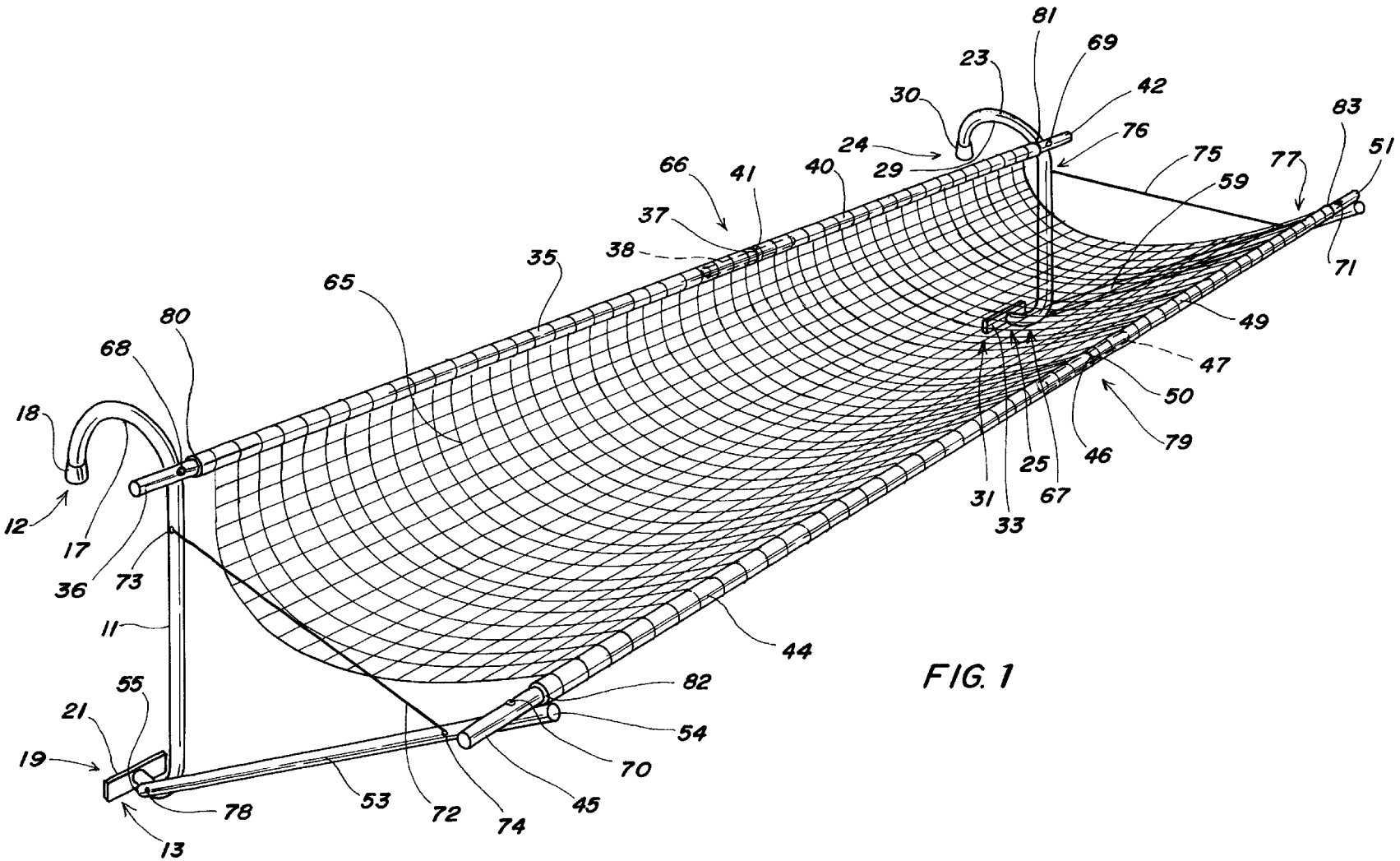
Figure 2:
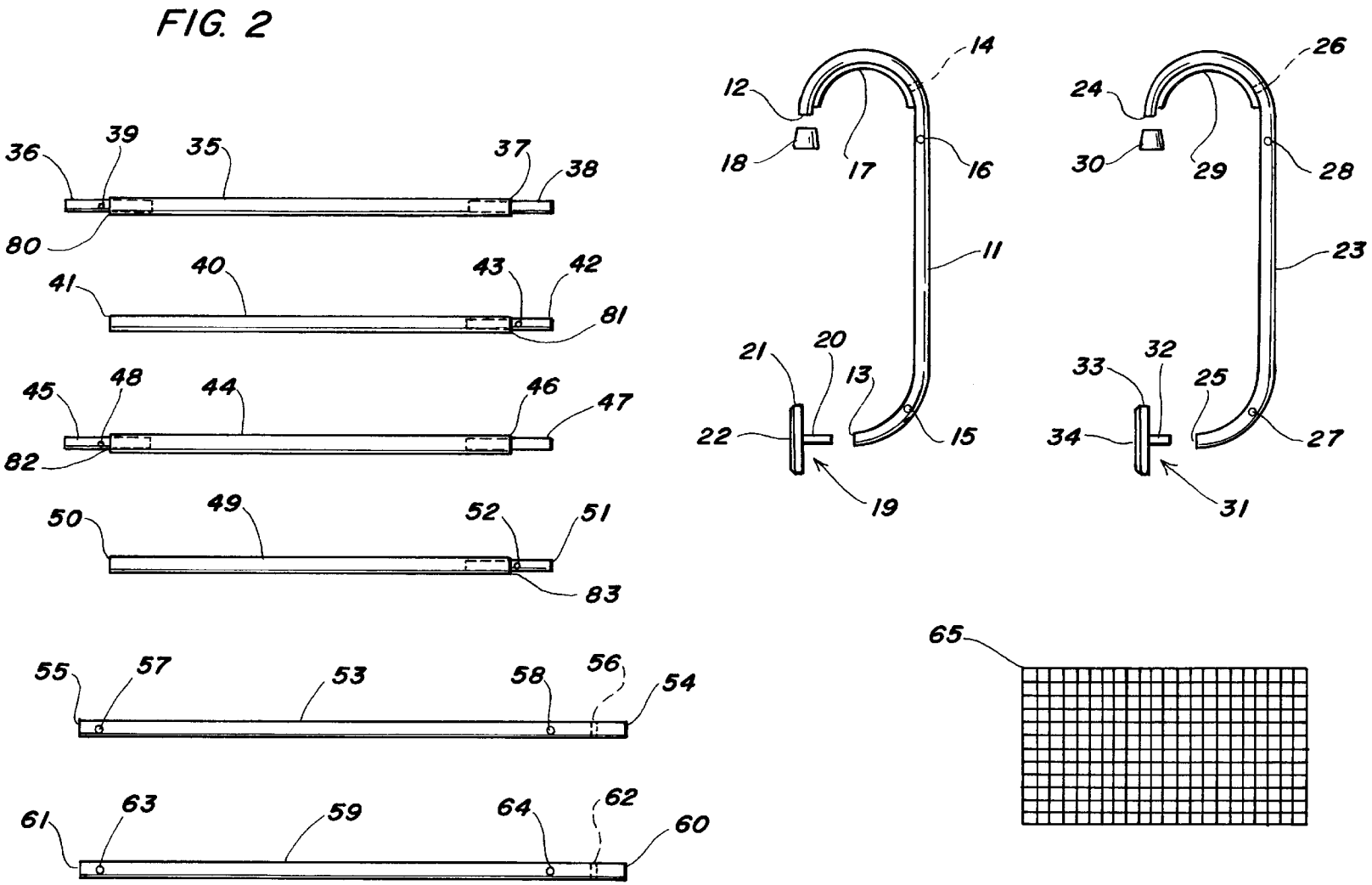

A detailed description of the swimming pool float net is best followed by referral to the accompanying drawings. FIG. 1 shows a perspective view of the swimming pool float net and FIG. 2 shows a flat view of broken down pieces of the major components of the swimming pool float net. This detailed description of the refers to both FIG. 1 and FIG. 2 simultaneously.

The swimming pool float net possesses two wall or fence hanging brackets 11 and 23 which are made of ⅞" outer diameter, ¾" inner diameter galvanized steel pipe with 20" long linear middle segments, half-circular top segments and quarter-circle bottom segments.

Bracket 11 has a top end 12, a ¾" plastic cap 18 inserted over the top end 12, a 1" wide rubber strip 17 attached to the underside of the half-circular pipe segment for padding, and a rotatable T-shaped stop 19 which inserts into the bottom end 13 of the bracket 11. The T-shaped bracket 19 is made of a 2" long ¾" outer diameter. ⅝" inner diameter pipe 20 welded to an 8" long, 1" wide, ⅛" thick, flat strip of steel 21, with a 1" wide rubber protective pad 22 attached to the steel strip 21.

Similarly, bracket 23 has a top end 24, a ¾" plastic cap 30 inserted over the top end 24, a 1" wide rubber strip 29 attached to the underside of the half-circular pipe segment for padding, and a rotatable T-shaped stop 31 which inserts into the bottom end 25 of the bracket 23. The T-shaped stop 31 is made of a 2" long ⅝" ID, ¾" OD pipe 32 welded to an 8" long, 1" wide, ⅛" thick flat strip of steel 33, with a 1"wide rubber protective pad 34 attached to the steel strip 33.

Bracket 11 possesses holes 14, 16, and 15, and bracket 23 possesses holes 26, 28, and 27, the functions of which will be explained later.

The swimming pool float netting 65 is suspended from two 84"long ¾" ID, ⅞" OD pipes, each such pipes being comprised of shorter 42" long pipes joined end-to-end. The inner pipe is comprised of a left pipe 35 and a right pipe 40. The left pipe 35 has a left end 80 into which is inserted a 7" long ¾" OD, ⅝" ID pipe connector 42 with a hole 39 (to be explained later) near the end 36 and a right end 37 with a 7" long ¾" OD, ⅝" ID extender pipe 38 securely attached by a rivet to the right end 37 of pipe 35. The right pipe 40 has a left end 41 and a right end 81 with a 7" long ¾" OD, ⅝" ID pipe connector 42 with a hole 43 (to be explained later) in the middle of 42. The two pipes 35 and 40 are joined by inserting the connecting pipe 38 at the right end 37 of pipe 35 into the left end 41 of pipe 40 to form a junction 66 between the two pipes 35 and 40.

Similarly, the outer pipe is comprised of a left ⅞" OD, ¾" ID pipe 44 and a right ⅞" OD, ¾" ID pipe 49. The left pipe 44 has a left end 82 into which a 7" long ¾" OD, ⅝" ID pipe connector 45 with a hole 48 (to be explained later) is inserted into the left end 44 and a right end 46 with a 7" long ¾" OD, ⅝" ID extender pipe 47 securely attached by a rivet to the right end 46 of pipe 44. The right pipe 49 has a left end 50 and a right end 83 with a 7"¾" OD, ⅝" ID connector pipe 51 with a hole 52 (to be explained later) inserted into the right end 83 of pipe 49. The two pipes 44 and 49 are joined by inserting the connecting pipe 47 at the right end 46 of pipe 44 into the left end 50 of pipe 49 to form a junction 79 between the two pipes 44 and 49.

The inner joined pipes 35 and 40 are connected via their pipe connectors 36 and 42 to the two brackets 11 and 23 respectively by ¼"×2" zinc screw bolts extending through connector holes 39, 14 and connector holes 42, 26 respectively, with such bolts secured with nuts.

The outer joined pipes 44 and 49 are joined via their pipe connectors 45 and 51 to the brackets 11 and 23 respectively by oblique pipes 53 and 59. Left oblique pipe 53 has a bottom end 55 with a hole 57 near it and a top end 54 with two holes 56 and 58 near it. Right oblique pipe 59 has a bottom end 61 with a hole 63 near it and a top end 60 with two holes 62 and 64 near it.

The bottom end 55 of left oblique pipe 53 is joined to the bottom of left bracket 11 by a ¼"×2" zinc screw bolt 78 inserted through holes 57 and 15 and secured by a nut. The top end 54 of left oblique pipe 53 is joined to the left end 82 of left pipe 44 via pipe connector 45, by a ¼"×2" zinc screw bolt 70 inserted through holes 48 and 56 and secured by a nut.

The bottom end 61 of right oblique pipe 59 is joined to the bottom of right bracket 23 by a ¼"×2" zinc screw bolt 67 inserted through holes 63 and 27 and secured by a nut. The top end 60 of right oblique pipe 59 is joined to the right end 83 of right pipe 49 via pipe connector 51 by a ¼"×2" zinc screw bolt 71 inserted through holes 52 and 62 and secured by a nut.

An optimal pocket shape of the netting 65 is maintained by keeping the oblique pipes 53 and 59 at 60 degree angles from the vertical sections of the brackets 11 and 23 respectively, by use of 3/16" thick 57" nylon cords 72 and 75, attached respectively through holes 16, 58 by 3/16" aluminum rivets 73, 74 and through holes 28, 64 by 3/16" aluminum rivets 76, 77. Various netting shapes and tensions can be adjusted by tying the left and right ends of the netting 65 to the tops of the brackets 11, 23 and tops of oblique pipes 53 and 59 with 5" nylon zip ties.

This swimming pool float net is attached to a swimming pool wall or fence by hanging the top of the brackets 11 and 23 over the top edge of the swimming pool wall or fence and resting the bottom of the brackets 11 and 23 against the side of the swimming pool wall or fence.

The swimming pool float net can be multiplied in size a number of times if desired by placing additional 7"¾" OD, ⅝" ID extender pipes identical to parts 38 and 47 into the pipe ends 80, 81, 82, and 83, and then adding additional pipe segments identical to parts 35, 40, 44, and 49, with additional nettings identical to part 65, along with additional identical brackets, pipe connectors, oblique pipes, and other parts already described.

This swimming pool float net is designed to hold only relatively light pool accessories such as floats and is not designed to hold heavy objects or children, so that a warning disclaimer to this effect is displayed prominently somewhere on the invention.

When the swimming pool float net is not being used temporarily, it may be folded, if desired, by pushing outer pipes 44–49 upward until oblique pipes 53, 59 are vertical and then tying pipes 53 and 59 respectively to brackets 11 and 23 with 10" nylon zip ties.

When the float net is not being used for long periods of time, it may be completely broken down and the netting folded up as shown in FIG. 2 for storage in a compact box.

It will be apparent that many modifications may be made in the specifications of the parts of this invention without departing from the spirit of the invention, and that the exact specifications given above are intended only to exemplify the best mode of the swimming pool float net known to the inventor at the present time.

What is claimed is:

1. A swimming pool float net comprising a rectangular netting suspended between two parallel horizontal poles, the inner pole being attached to the top of a set of parallel vertical brackets which hang on a swimming pool wall or fence by virtue of curved overhanging tops, and the outer pole being attached by two parallel oblique poles to the bottoms of the brackets, which bottoms possess foot pads that rest firmly against the side of the swimming pool wall or fence.

2. A swimming pool float net comprising a rectangular netting suspended between two parallel horizontal poles, the inner pole being attached to the top of a set of parallel vertical brackets which hang on a swimming pool wall or fence by virtue of curved overhanging tops, and the outer pole being attached by two parallel oblique poles to the bottoms of the brackets, which bottoms possess foot pads that rest firmly against the side of the swimming pool wall or fence, and wherein the angle of the oblique poles is held at a maximum from the vertical brackets by two cords connecting the brackets to the oblique poles.

3. A swimming pool float net as described in claim 2 wherein the said parallel horizontal poles are comprised of segment poles held together by short connecting poles inserted into the ends of the joined segment poles.

4. A swimming pool float net as described in claim 3 wherein the said poles and brackets are comprised of ⅞" outer diameter, ¾" inner diameter galvanized steel pipe and the said short connecting poles are comprised of ¾" outer diameter, ⅝" inner diameter galvanized steel pipe.

* * * * *